United States Patent [19]

Marshall et al.

[11] 4,009,817

[45] Mar. 1, 1977

[54] TRAY FOR SHIPMENT OF FROZEN ITEMS

[75] Inventors: Paul W. Marshall, Tulsa, Okla.; Harold C. Singleton, Dallas, Tex.; Clyde L. Copp, Tulsa, Okla.; Floyd L. Lankford, Tulsa, Okla.; Patsy L. George, Tulsa, Okla.

[73] Assignee: Bama Pie, Inc., Tulsa, Okla.

[22] Filed: June 25, 1976

[21] Appl. No.: 700,067

[52] U.S. Cl. ..... 229/2.5 R; 206/499; 229/15

[51] Int. Cl.[2] ..... B65D 1/24

[58] Field of Search ..... 229/2.5, 15; 206/499

[56] References Cited

UNITED STATES PATENTS

| | | | |
|---|---|---|---|
| 3,236,403 | 2/1966 | Steinberg | 229/2.5 X |
| 3,707,227 | 12/1972 | Britt | 229/2.5 X |
| 3,866,817 | 2/1975 | Holden, Jr. | 229/15 |
| 3,926,363 | 12/1975 | Catron | 206/499 |

*Primary Examiner*—Davis T. Moorhead
*Attorney, Agent, or Firm*—William S. Dorman

[57] ABSTRACT

A tray for the shipment of frozen items such as frozen pies which is stackable within a box with other identical trays so that each individual frozen item is prevented from contact with any other frozen item. The tray has a bottom from which four sides extend outwardly and upwardly. The sides comprise a longitudinal pair of sides and a lateral pair of sides. A plurality of projections extend upwardly along the center line between the longitudinal sides, and two rows of protuberances, one row located on each side of the plurality of projections, extend upwardly. The plurality of projections forms a divided partition. Each protuberance is formed by a long slope which extends upwardly from the bottom of the tray towards one lateral side of the tray and by a short slope which extends almost vertically downwardly from the upper end of the long slope to the bottom of the tray. Thus, each protuberance has a resulting inverted "L" shape along its longitudinal cross-section. The long slopes of all the protuberances are orientated toward the same lateral side. Each frozen item is prevented from contact with another frozen item by the protuberances and the divided partition. The frozen items which are adjacent a long slope lie along the long slope, and thus assume an inclined position with respect to the flat bottom of the tray.

6 Claims, 5 Drawing Figures

TRAY FOR SHIPMENT OF FROZEN ITEMS

BACKGROUND OF THE INVENTION

1. Field of the Invention

This invention relates to a tray for the shipment of frozen items. More particularly, this invention relates to a tray for frozen items which prevents a frozen item from contact with any other frozen item during the shipment thereof.

2. Description of the Prior Art

Fried pies are sold in large numbers at restaurants, particularly, drive-in restaurants which also feature hamburgers, malted drinks, etc. These fried pies are generally prepared at these restaurants by taking uncooked pies, which have previously been frozen, and cooking them in a deep fat frier.

The pies are shipped in a frozen condition from the point of manufacture through a distribution system in a frozen condition and finally to a particular restaurant, where they are to be cooked and sold. The pies are generally arranged in trays which, in turn, are arranged in shipping boxes or cartons. The boxes with trays of frozen pies therein, from the time of manufacture and packaging until they reach their final destination, are stored in trucks and warehouses where the temperature is maintained considerably below freezing.

One of the final steps in the manufacture of the pies is the covering of these pies, now frozen, with a liquid glaze which immediately freezes on the surface of the pies. This glaze produces the brown appearance on the surface when the pie is cooked.

During the terminal stage of shipment or possibly during stages of transit from truck to warehouse, it is possible for the pies to be exposed to a high enough ambient temperature for a sufficient period of time to cause the glaze to melt or soften. This melting or softening of the glaze sometimes causes two or more pies to stick together. When these stuck pies are later separated, it is possible for the dough covering to tear away from one or more pies and spill the contents into the fat of the deep fat frier. This contamination could create obvious problems involving the subsequent usage of the fat in the deep fat frier.

Therefore, it is a principal object and purpose of this invention to keep the pies separated from one another to prevent any possibility of their sticking together.

It is known to ship frozen pies in boxes and trays. Reference is made to the U.S. Pat. No. 3,926,363, Catron, "Stacking Trays and Container for Perishable Items", issued on Dec. 16, 1975. The Catron patent shows a tray which is rectangular (non-square). The trays are stacked one on top of another in a box with each tray being turned 90° out of orientation with the adjacent trays. The tray has a central projection which separates one group of frozen items from another group thereof. The tray provides no separation for the individual frozen items in a group. Although the Patent refers to fried pies, it is known that the tray described in Catron is utilized to transport frozen pies.

SUMMARY OF THE INVENTION

The present invention involves a tray for frozen items, for example, frozen pies, which is stackable within a box. The tray has a bottom and four sides which connect with the bottom and extend upwardly and outwardly therefrom forming a pair of lateral and a pair of longitudinal sides.

The tray also has a plurality of projections which extend upward from the flat bottom. These projections are located along the center line between the longitudinal sides of the tray and form a divided partition. Two rows of protuberances, one row located on each side of the partition, extend upwardly from the bottom. Each protuberance has a long slope which extends upwardly from the bottom of the tray towards one lateral side of the tray and by a short slope which extends almost vertically downwardly from the upper edge of the long slope to the bottom of the tray. Thus each protuberance has a resulting inverted L shape along its longitudinal cross-section.

Each frozen item is placed, for example, lengthwise between the protuberances of a row, or between a protuberance located at each end of a row and a lateral side, so that each frozen item will be provided with a space and thereby separated from contact with the other frozen items by the plurality of projections and the protuberances. The protuberances are located sufficiently close together (and to the lateral side adjacent the long slope of the end protuberance) such that the frozen item will rest against the bottom and the short slope of one protuberance (or a lateral side in the case of the frozen item on the end of each row adjacent a long slope) and lie on the long slope of the next protuberance. Thus, the frozen items will be inclined except for the frozen item in each row placed between the lateral side toward which the short slopes are orientated and the short slope of the protuberance, which is located at that end. A stacking lip is provided around the rim of the sides of the tray to aid in maintaining separation when the trays are stacked prior to the placement of frozen items therein.

When the trays which could, for example, be square, are stacked in a box, the lower side of the flat bottom of the tray above will prevent the frozen items in the lower tray from moving over the plurality of projections and the protuberances if the box is inclinded.

DESCRIPTION OF THE PREFERRED EMBODIMENT

Figure 1:
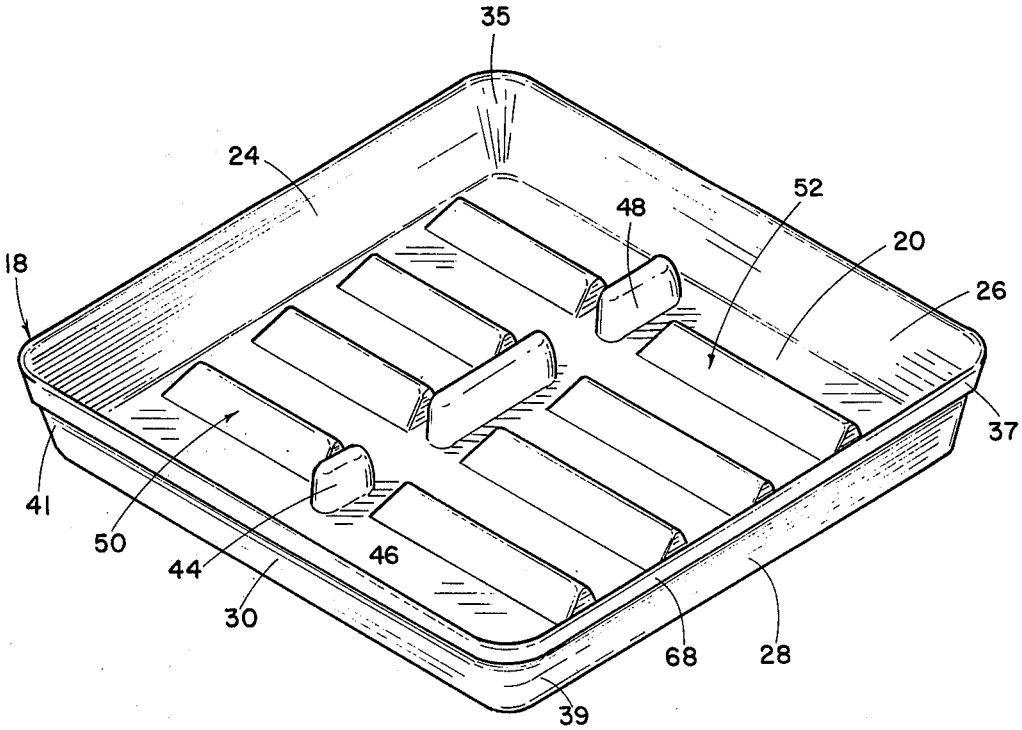
FIG. 1 is a view in perspective of a tray for frozen items constructed according to the present invention.
Figure 2:
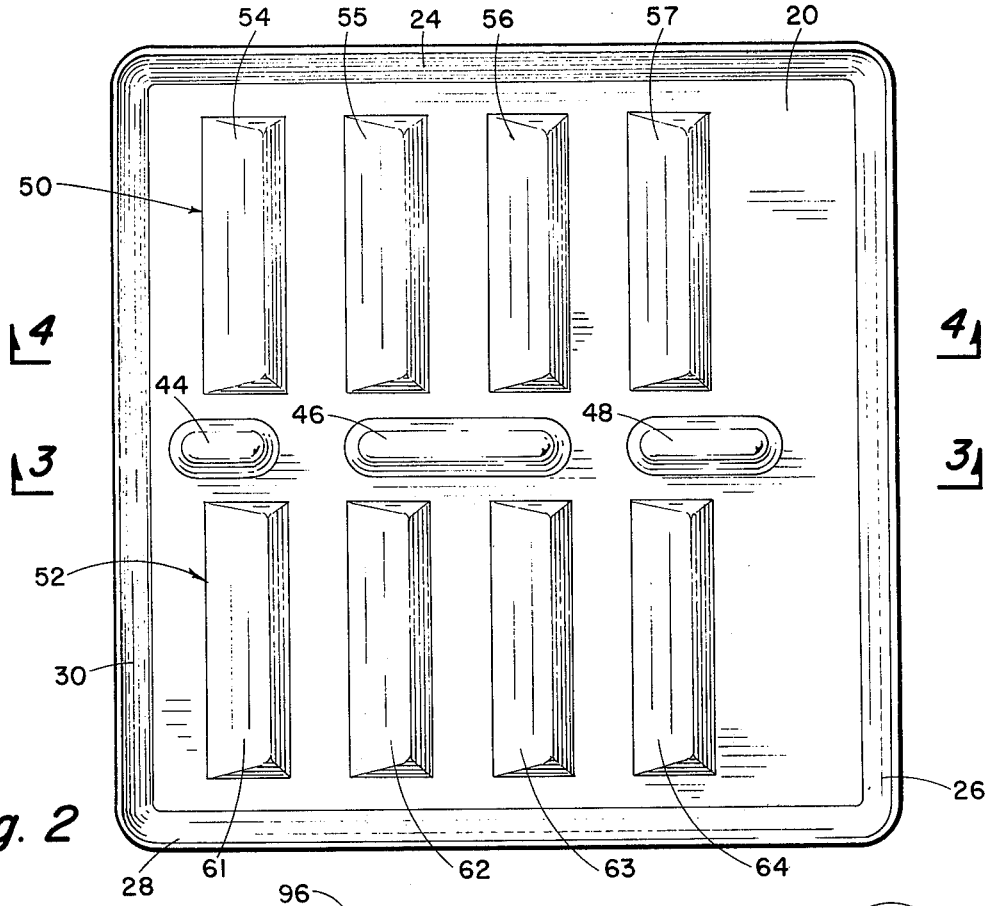
FIG. 2 is a top view of the tray shown in FIG. 1.

The tray 18, as shown in FIG. 1, has a square bottom 20, and four upwardly and slightly outwardly inclined sides 24, 26, 28 and 30. The sides form a pair of longitudinal sides 24 and 28, and a pair of lateral sides 26 and 30. The sides are of equal length and are connected by rounded corners. The sides 24 and 26, 26 and 28, 28 and 30, and 24 and 30 being connected at corners 35, 37, 39, and 41, respectively. A plurality of projections 44, 46, and 48 forms a divided partition along a longitudinal center line between the two longitudinal sides 24 and 28. These projections extend upward from the bottom 20 of tray 18 and are shown as having a generally elongated eliptical shape when viewed from above (FIG. 2) and are rounded off at the top. Two rows of protuberances 50 and 52, one of which is located on each side of projections 44, 46, and 48, extend upwardly from bottom 20. As shown in FIG. 2, row 50 has protuberances 54 through 57, and row 52 has protuberances 61 through 64. Each protuberance extends laterally from the divided partition towards one longitudinal side, either 24 or 28, of the tray. Further, each protuberance has an inverted L shape along its lateral cross-section formed by a long slope extending to an upper edge and a short slope which extends almost vertically downwardly from the upper edge (to be discussed in detail hereinafter).

Figure 3:
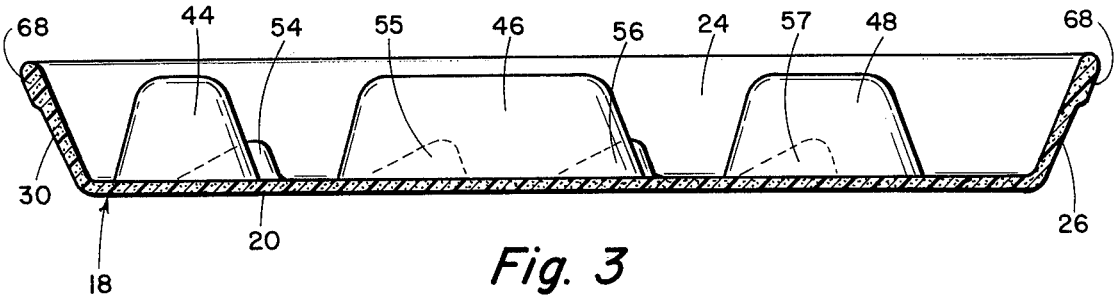
FIG. 3 is a cross-sectional view, on a slightly enlarged scale, taken along section line 3—3 of FIG. 2.

As shown in FIG. 3, the bottom 20 and the sides (only the section of sides 26 and 30 is shown) have approximately the same thickness throughout except that the sides have a thicker stacking lip 68 (also shown in FIG. 1) at their upper rims. The stacking lip allows the trays to be easily stacked one on top of another prior to the placement of frozen items therein. The lip extends downward vertically from the upper rims. Thus, when the trays are stacked, the stacking lip of one tray will engage the upper rims of the sides of the tray beneath it.

Figure 4:
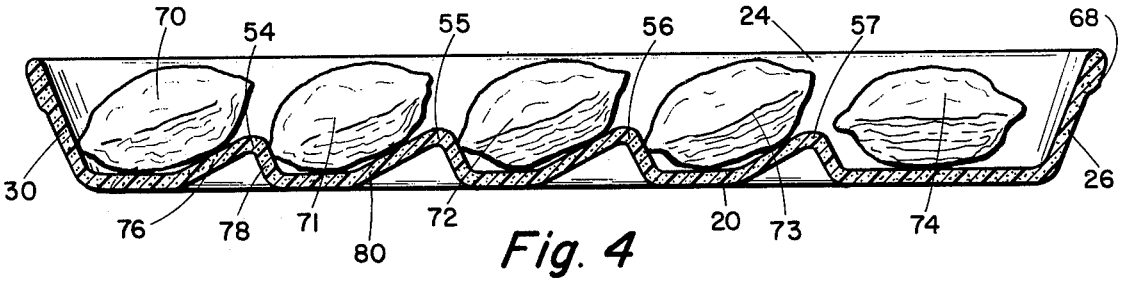
FIG. 4 is a cross-sectional view, on a slightly enlarged scale, taken along section line 4—4 of FIG. 2 with frozen items added.

In FIG. 4, it can be seen that the thickness of the protuberances (only 54 through 57 are shown) is approximately the same as the bottom 20. The same is true for the thickness of the projections 44, 46, and 48 (although a section is not shown).

Molded polystyrene foam is the preferred material for construction of the trays; however other similar foams or plastic materials such as polyurethane can also be utilized. Thus, the tray including the sides, projections and protuberances, can be formed in one piece.

In the shipment of certain frozen items such as frozen pies, it is desirable that the items not be in contact with one another during shipment. For example, frozen pies are usually coated with a glaze, for example, a milk glaze, after being frozen but prior to shipment. If, during shipment, or any other time before use, the temperature should rise above the melting temperature of the glaze and then refreeze and the pies are in contact, the pies may become stuck together. After the pies are stuck together, separating the pies later for use may damage one or both pies.

Frozen items 70 through 74 are shown in their proper positions in row 50 (FIG. 4). Frozen item 70 is shown with one side resting against lateral side 30 and with a portion of its lower surface lying against the long slope 76 of the L shaped protuberance 54. This maintains item 70 in an inclined position. Frozen item 71 is resting against the short slope 78 of protuberance 54 and is supported by lying against long slope 80 of protuberance 55 in an inclined position. Frozen items 72 and 73 are positioned between their respective protuberances, 55 and 56, and 56 and 57, in a manner similar to the positioning of item 71 between protuberances 54 and 55. Frozen item 74 is positioned lying on bottom 20 between protuberance 57 and lateral side 26. It should be noted that all of the frozen items are in contact with bottom 20. Another five frozen items (not shown) would be similarly positioned on the other side of the projections associated with row 52 (FIG. 1).

Referring to FIGS. 3 and 4, it can be seen that, although the partition provided by projections 44, 46, and 48 is divided, the frozen items 70 through 74 are situated such that, if they moved from row 50 toward the other lateral side (side 28), they will be prevented from contact with the frozen items (not shown) associated with row 52 by the projections 44, 46, and 48. This is because a portion of the space between each of the frozen items 70 through 74 and its counterpart in row 52 is occupied by a portion of one of the projections. Further, (as described above) each frozen item is prevented from contact with any other frozen item in its row by the protuberances associated with it.

Figure 5:
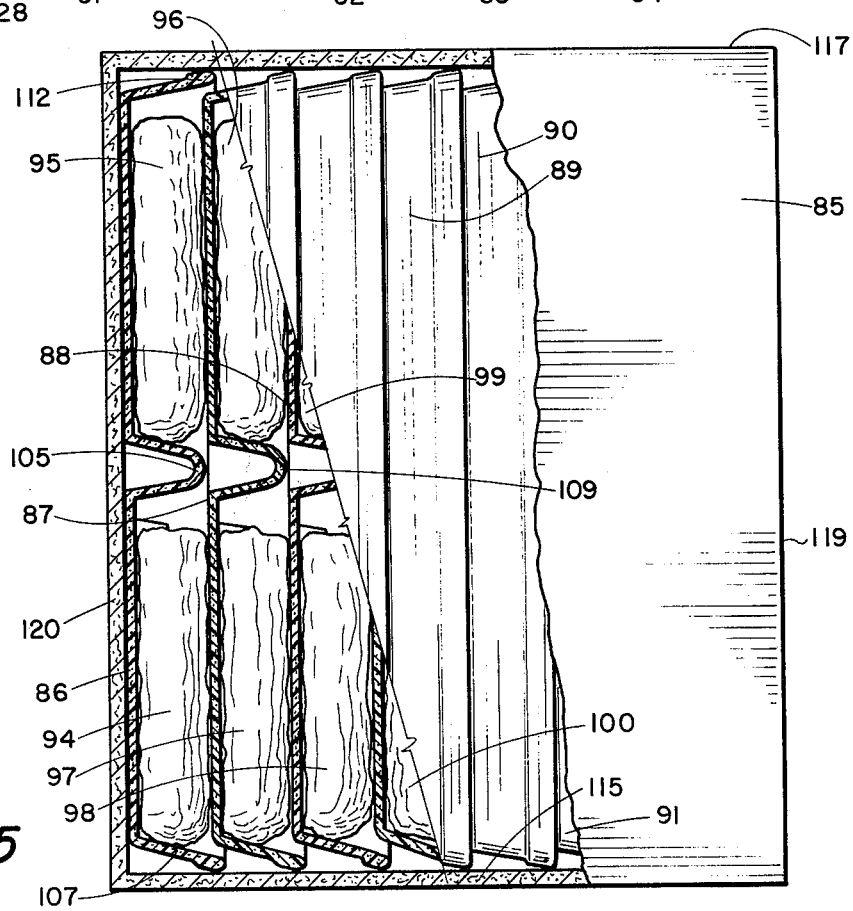
FIG. 5 is a side view of a box with portions cut away to reveal trays constructed according to the present invention stacked within the box and with portions of the trays cut away to reveal frozen items located within the trays.

Trays 86 through 91 (but not all are shown) are shown stacked in a box 85 (FIG. 5) with frozen items (only 94 through 100 are shown) placed therein. The box is shown in the preferred shipping position with the bottom of the trays vertical and the center line along which the plurality of projections is located horizontal. Thus, the upper (as shown in FIG. 5) row of frozen items rests against the plurality of projections of its respective tray, for example, frozen item 95 resting against projection 105 of tray 86. The lower (as shown in FIG. 5) row of frozen items rests against the lower side of its respective tray, for example, frozen item 94 rests against side 107 of tray 86. The frozen items are also held in place by the next tray in the stack. In the stacked arrangement, as shown in FIG. 5, a portion of all the frozen items inclined by a protuberance will fit or nest into the hollow (as shown in FIG. 4) formed below in the similarly situated protuberance in next tray.

If the trays are placed as shown in FIG. 5, the projections in one tray would fit or nest into the projections of the next tray, for example, projection 105 of tray 86 into projection 109 of tray 87. In the preferred embodiment of the tray 18 (FIGS. 1 and 3) the projections are not the same size nor spaced symmetrically with respect to the lateral sides 26 and 30. Thus, if desired when stacking the trays, the trays can be turned alternately 180° and the projections of a tray would not fit or nest into the hollows associated with the projections of the next tray. This would provide spacing between trays. The trays might also be stacked by turning each tray 90° from the prior tray.

Referring again to FIG. 5, the box 85 is of a suitable size such that the stacking lips of the trays engage the inside walls of the box when stacked therein, for example, stacking lip 112 of tray 86. The weight of the frozen items rest on the tray (as discussed above) and is transmitted to lower wall 115 of the box. The weight of other similar boxes (not shown) or goods stacked on top of box 85 would be supported by box 85 and by the trays located (only 86 through 90 are shown in FIG. 5) therein. Thus, the trays in this position (with side 115 down) add strength and support capability to box 85.

The shape of the tray could be varied, for example, to be rectangular. Further, there could be more or less than four protuberances per row depending on the shape of the tray and the desired spacing. The partition between rows of protuberances could be solid.

SUMMARY OF THE OPERATION

The frozen items are placed (as discussed above) in two rows in the tray 18. The tray along with other similarly filled trays in alignment are stacked within a box of suitable dimensions. The stacking might be performed mechanically by opening a wall of the box, for example, wall 117, and sliding the trays into the box sideways. The box would have wall 120 down and would, after being filled, be moved to the preferred shipping position (wall 115 down) as discussed above. An alternative method would be to manually stack the trays from the top by opening wall 119 (with wall 120 being down). The box would then be moved to the preferred shipping position.

Whereas the present invention has been described in particular relation to the drawings attached thereto, it should be understood that other and further modifications, apart from those shown or suggested herein, may be made within the spirit and scope of this invention.

What is claimed is:

1. A tray for shipment of frozen items, comprising a bottom, a pair of opposite longitudinal sides and a pair of opposite lateral sides, each longitudinal side being connected to the lateral sides at right angles thereto, each side extending upwardly and outwardly from said bottom, a plurality of projections located along a longitudinal center line between the longitudinal sides and extending upwardly from said bottom for forming a divided partition, a first row of protuberances located between said partition and one of said longitudinal sides, a second row of protuberances located between said partition and another of said longitudinal sides opposite to the one side thereof, each protuberance extending upwardly from said bottom and laterally away from adjacent said plurality of projections to adjacent one of the two longitudinal sides, each protuberance having a long slope extending upwardly from said bottom towards one lateral side and terminating in an upper edge, each protuberance having a short slope extending almost vertically from the upper edge to said bottom whereby said tray provides a separate space for a frozen item adjoining each long slope and between said one lateral side and each adjacent short slope.

2. A tray for the shipment of frozen items as set forth in claim 1 wherein said bottom is square.

3. A tray for shipment of frozen items as set forth in claim 1 wherein said plurality of projections is laterally asymmetrical for providing separation when trays are stacked one on top of another and turned 180° relative to each other.

4. A tray for shipment of frozen items as set forth in claim 1 wherein said bottom is a given thickness, each projection of said plurality of projections and each protuberance of said first and second rows of protuberances being substantially said given thickness for forming hollows beneath each protuberance and each projection.

5. A tray for shipment of frozen items as set forth in claim 1 wherein each side has an upper rim, said upper rim being provided with a stacking lip extending downwardly for resting on an upper rim of a tray stacked in alignment therebelow.

6. A tray comprising a square bottom, a pair of opposite longitudinal sides and a pair of opposite lateral sides connected to each other and extending upwardly and outwardly from said bottom, a plurality of projections located along a longitudinal center line between the longitudinal sides and extending upwardly from said bottom for forming a divided partition, a first row of protuberances located between said partition and one of said longitudinal sides, a second row of protuberances located between said partition and the other longitudinal side, each protuberance extending upwardly from said bottom and laterally away from adjacent said plurality of projections to adjacent one of the two longitudinal sides, each protuberance having a long slope extending upwardly from said bottom towards one lateral side and terminating in an upper edge, each protuberance having a short slope extending almost vertically from the upper edge to said bottom.

* * * * *